US008776736B2

(12) United States Patent
Woo et al.

(10) Patent No.: US 8,776,736 B2
(45) Date of Patent: Jul. 15, 2014

(54) VARIABLE COMPRESSION RATIO APPARATUS

(75) Inventors: Yoonsik Woo, Yongin-si (KR); Juhun Lee, Gwangmyeong-si (KR); Eunho Lee, Hwaseong-si (KR); Jinkook Kong, Suwon-si (KR); Soohyung Woo, Yongin-si (KR)

(73) Assignee: Hyundai Motor Company, Seoul (KR)

( * ) Notice: Subject to any disclaimer, the term of this patent is extended or adjusted under 35 U.S.C. 154(b) by 96 days.

(21) Appl. No.: 13/523,484

(22) Filed: Jun. 14, 2012

(65) Prior Publication Data

US 2013/0118455 A1 May 16, 2013

(30) Foreign Application Priority Data

Nov. 14, 2011 (KR) ..... 10-2011-0118186

(51) Int. Cl.
*F02B 75/04* (2006.01)
*F02D 15/02* (2006.01)

(52) U.S. Cl.
USPC ... 123/48 B; 123/48 R; 123/48 A; 123/48 AA

(58) Field of Classification Search
CPC ..... F02B 75/045
USPC ..... 123/197.2, 197.3, 197.4, 78 E, 78 BA, 123/48 R, 48 A, 48 AA, 48 B; 74/579 E, 586, 74/602
See application file for complete search history.

(56) References Cited

U.S. PATENT DOCUMENTS

| | | | | | |
|---|---|---|---|---|---|
| 1,514,652 | A * | 11/1924 | Burmaster | 403/340 |
| 3,908,623 | A * | 9/1975 | McWhorter | 123/197.2 |
| 4,301,695 | A * | 11/1981 | Reiher | 74/602 |
| 4,836,045 | A * | 6/1989 | Lobig | 74/579 E |
| 5,666,637 | A * | 9/1997 | Fujiki et al. | 419/27 |
| 6,038,943 | A * | 3/2000 | Vogelsang | 74/579 E |
| 6,581,552 | B2 * | 6/2003 | Kreuter | 123/48 R |
| 6,752,105 | B2 * | 6/2004 | Gray, Jr. | 123/48 B |
| 7,028,647 | B2 | 4/2006 | Styron | |
| 7,066,118 | B2 * | 6/2006 | Hirano | 123/48 B |
| 7,174,863 | B2 * | 2/2007 | Scalzo | 123/48 B |
| 8,397,684 | B2 * | 3/2013 | Yang et al. | 123/48 R |
| 8,539,917 | B2 * | 9/2013 | Lee | 123/48 B |
| 2007/0277755 | A1 * | 12/2007 | Nakamura et al. | 123/90.16 |

(Continued)

FOREIGN PATENT DOCUMENTS

| | | |
|---|---|---|
| EP | 1 811 151 A2 | 7/2007 |
| JP | 2005-69270 A | 3/2005 |

(Continued)

*Primary Examiner* — Lindsay Low
*Assistant Examiner* — Tea Holbrook
(74) *Attorney, Agent, or Firm* — Morgan, Lewis & Bockius LLP

(57) ABSTRACT

A variable compression ratio (VCR) apparatus, may include a piston, a connecting rod having one end coupled to the piston through a piston pin so as to transmit a motion of the piston to a crank shaft, a pair of first and second eccentric links having one ends eccentrically connected to the one end of the connecting rod through the piston pin, dual swing links having one ends connected to the other ends of the first and second eccentric links, respectively, so as to pivot the eccentric links with respect to the piston pin, and connecting assembly connecting the one ends of the first and second eccentric links each other.

6 Claims, 5 Drawing Sheets

(56) References Cited

U.S. PATENT DOCUMENTS

| | | | | |
|---|---|---|---|---|
| 2010/0180868 | A1* | 7/2010 | Scalzo | 123/48 B |
| 2012/0042854 | A1* | 2/2012 | Lee et al. | 123/48 B |
| 2012/0118270 | A1* | 5/2012 | Lee | 123/48 B |
| 2013/0042837 | A1* | 2/2013 | Woo et al. | 123/48 B |
| 2013/0118454 | A1* | 5/2013 | Woo et al. | 123/48 B |
| 2013/0125701 | A1* | 5/2013 | Woo et al. | 74/586 |

FOREIGN PATENT DOCUMENTS

| | | | |
|---|---|---|---|
| JP | 2005-207390 | A | 8/2005 |
| KR | 10-2011-0001511 | A | 1/2011 |
| KR | 10-1028181 | B1 | 4/2011 |

* cited by examiner

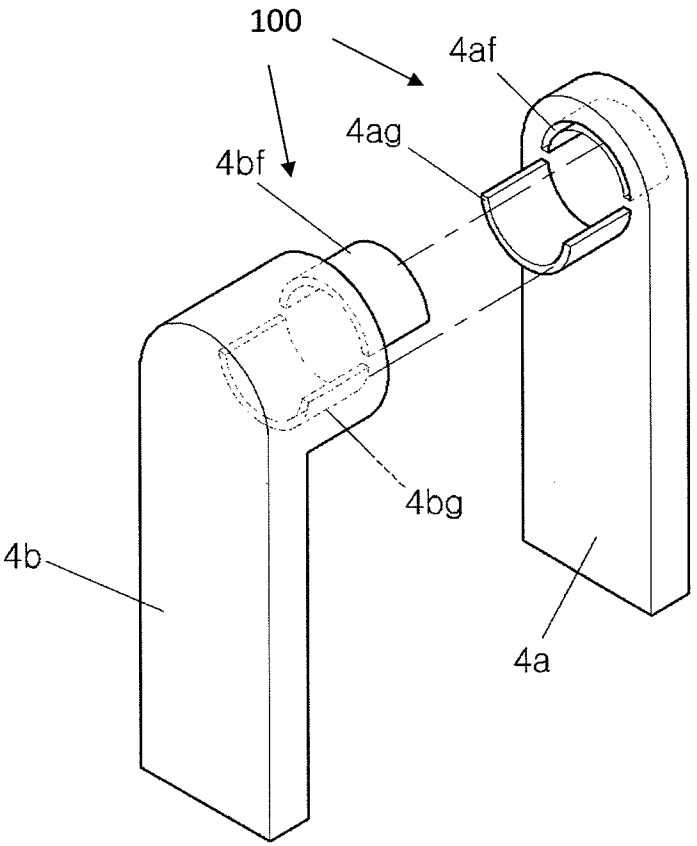
FIG.5
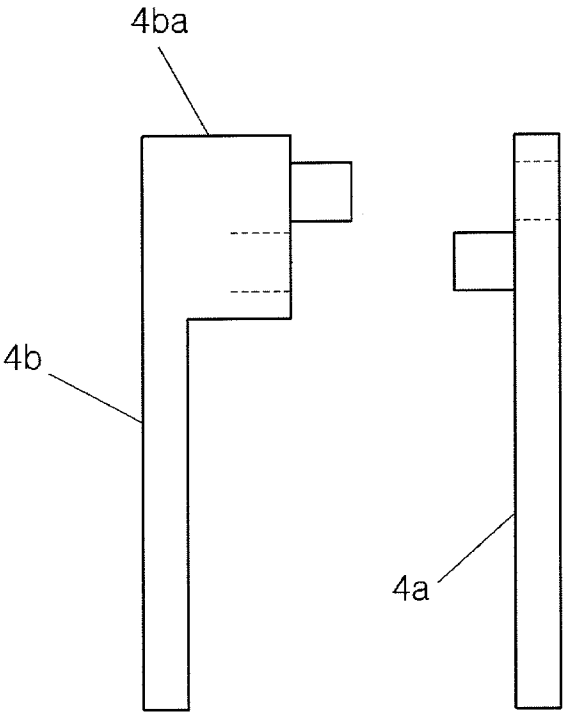

VARIABLE COMPRESSION RATIO APPARATUS

CROSS-REFERENCE TO RELATED APPLICATIONS

The present application claims priority to Korean Patent Application Number 10-2011-0118186 filed Nov. 14, 2011, the entire contents of which application is incorporated herein for all purposes by this reference.

BACKGROUND OF THE INVENTION

1. Field of the Invention

The present invention relates to a variable compression ratio (VCR) apparatus, and more particularly, to a VCR apparatus having dual eccentric links and dual swing links.

2. Description of Related Art

In general, the thermal efficiency of a heat engine increases when a compression ratio is high. In the case of a spark ignition engine, the thermal efficiency thereof increases when ignition timing is advanced to a predetermined level.

In the spark ignition engine, however, when the ignition timing is advanced at a high compression ratio, abnormal combustion may occur to cause engine damage. Therefore, there is a limit in advancing the ignition timing. Thus, the spark ignition engine should endure an output reduction.

A VCR apparatus serves to change the compression ratio of gas mixture depending on an operation state of an engine.

The VCR apparatus improves fuel efficiency by increasing the compression ratio of the gas mixture in a low-load condition of the engine. Further, the VCR apparatus prevents the occurrence of knocking and improves engine power by reducing the compression ratio of the gas mixture in a high-load condition of the engine.

U.S. Pat. No. 6,581,552 has disclosed a VCR apparatus according to the related art. The VCR apparatus includes a connecting rod having one end connected to a piston forming a combustion chamber and the other end connected to a crank shaft. The one end of the connecting rod is coupled to an eccentric ring. The eccentric ring is connected to one end of an eccentric swing member. The other end of the eccentric swing member is connected to a slide through a coupling. The slide is connected to a driving device so as to be moved by the driving device.

The slide is moved by the operation of the driving device, and the motion of the slide is transmitted to the eccentric swing member through the coupling so as to rotate the eccentric swing member. The rotation of the eccentric swing member varies the top dead center of the piston through the connecting rod, thereby changing the compression ratio of the combustion chamber formed by the piston.

In the VCR apparatus according to the related art, the structural stiffness and stable operation of the eccentric swing member are required, and the structure of the eccentric swing member needs to be simplified.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a VCR apparatus capable of stabilizing load balancing to secure dynamic stability of a swing operation, strengthening structural stiffness, and improving assembling workability.

In an aspect of the present invention, a variable compression ratio (VCR) apparatus may include a piston, a connecting rod having one end coupled to the piston through a piston pin so as to transmit a motion of the piston to a crank shaft, a pair of first and second eccentric links having one ends eccentrically connected to the one end of the connecting rod through the piston pin, dual swing links having one ends connected to the other ends of the first and second eccentric links, respectively, so as to pivot the eccentric links with respect to the piston pin, and connecting assembly connecting the one ends of the first and second eccentric links each other.

The piston may have an assembling groove formed toward the inside from the bottom thereof, and the one end of the connecting rod and the one ends of the first and second eccentric links are inserted into the assembling groove and connected to the piston through the piston pin.

The one ends of the swing links are pivotally coupled to the other ends of the first and second eccentric links.

The other ends of the swing links are integrally connected to each other at a connection portion so as to form a single body, and the connection portion may have a pin boss extended in two parts in the opposite direction of the one ends of the swing links such that a driving device for swinging the swing links is connected to the swing links through the pin boss and a pin.

The connecting rod may have an assembling hole formed through the one end thereof, and the connecting assembly may include a circular boss formed in the one end of the first eccentric link and protruding to be inserted into the assembling hole, and a plurality of assembling protrusions formed in the one end of the second eccentric link and arranged in a circumferential direction so as to be closely attached to an outer circumference of the boss.

The connecting rod may have an assembling hole formed through the one end thereof, and the connecting assembly may include a circular boss formed in the one end of the first eccentric link and protruding to be inserted into the assembling hole, a plurality of gear teeth formed along a circumferential direction on an outer circumference of the boss, and a plurality of gear teeth formed in the one end of the second eccentric link so as to be engaged with the gear teeth of the boss.

The connecting rod may have an assembling hole formed through the one end thereof, and the connection assembly may include a circular boss formed in the one end of the first eccentric link and protruding to be inserted into the assembling hole, wherein the boss may include a spline gear formed to be engaged with a spline gear formed to the one end of the second eccentric link.

The connecting rod may have an assembling hole formed through the one end thereof, and the connection assembly may include a circular boss formed in the one end of the first eccentric link and protruding to be inserted into the assembling hole, a pair of arc-shaped assembling protrusion portions protruding on a side surface of the boss facing the second eccentric link and formed symmetrically in a vertical direction, and a pair of arc-shaped assembling grooves or assembling holes formed at a side surface of the second eccentric link facing the boss and disposed symmetrically in a vertical direction so as to be coupled to the pair of assembling protrusions.

The connecting rod may have an assembling hole formed through the one end thereof, and the connection assembly may include a circular boss formed in the one end of the first eccentric link and protruding to be inserted into the assembling hole, an arc-shaped assembling protrusion portion and an arc-shaped assembling groove or assembling hole formed at a side surface of the boss facing the second eccentric link and disposed symmetrically in a vertical direction, an assembling groove or assembling hole formed at a side surface of the second eccentric link facing the boss and inserted and coupled into the assembling protrusion portion of the first eccentric link, and an assembling protrusion portion formed symmetrically with the assembling groove or assembling hole and protruding to be inserted into the assembling groove or assembling hole of the first eccentric link.

In the VCR apparatus according to the exemplary embodiment of the present invention, the eccentric links having one ends coupled to the piston and the connecting rod are constructed in a dual link type such that a load is uniformly distributed to the dual eccentric links. Therefore, the VCR apparatus has an advantage in terms of load balancing, the structural stiffness as well as the dynamic stability during the swing operation of the eccentric links may be improved, and partial abrasion of a main bearing may be prevented. As the eccentric links perform a stable swing operation, a guide unit for improving the motion stability of the eccentric links is not necessary. Therefore, the structure may be simplified, and the apparatus may be easily manufactured. Further, the assembling workability may be improved by various coupling methods of the eccentric links, and the apparatus may be applied to various kinds of vehicles.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

BRIEF DESCRIPTION OF THE DRAWINGS

FIG. 5 is an exploded perspective view explaining a coupling method of eccentric links according to still another exemplary embodiment of the present invention.

Figure 1:
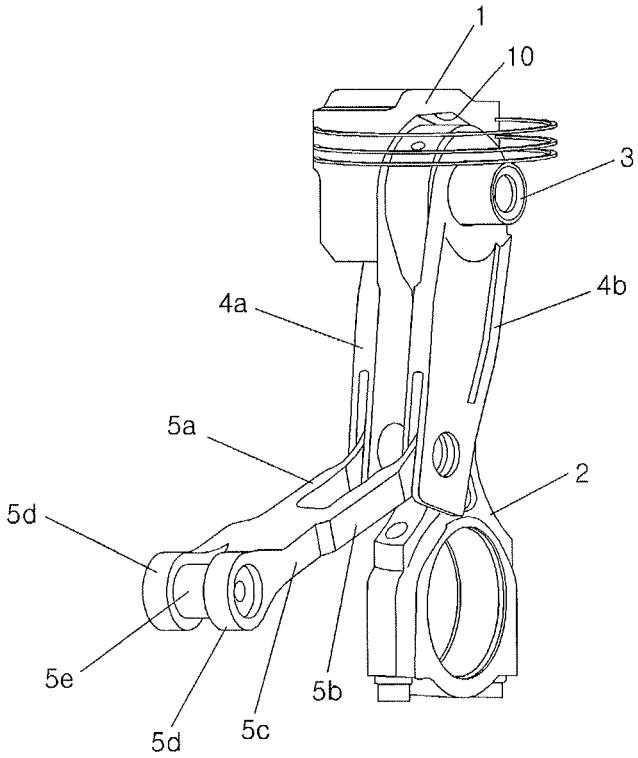
FIG. 1 is a perspective view of a VCR apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Referring to FIG. 1, a piston 1 forming a combustion chamber has an assembling groove 10 formed toward the inside from the bottom thereof, and a connecting rod 2 has one end inserted into the assembling groove 10 and coupled to a piston pin 3.

Piston 1 has an assembling hole formed in a diametric direction and communicating with the assembling groove 10, and piston pin 3 is inserted into the assembling hole to connect the one end of connecting rod 2 to piston 1.

The other end of connecting rod 2 is coupled to a crank shaft, and a vertical motion of the connecting rod is converted into a rotational motion of the crank shaft.

At both sides of connecting rod 2, a pair of eccentric links 4*a* and 4*b* are disposed in a dual link type. Eccentric links 4*a* and 4*b* have one ends inserted into the assembling groove 10 of piston 1 and eccentrically connected to the one end of connecting rod 2 through piston pin 3. In various embodiments, a connecting assembly 100 connects the one ends of the first and second eccentric links to each other.

The other ends of eccentric links 4*a* and 4*b* are connected to one ends of swing links 5*a* and 5*b* formed in a dual link type, respectively, through a pin.

The other ends of swing links 5*a* and 5*b* are integrally connected to each other at a connection portion 5*c* so as to form one body. The connection portion 5*c* includes a pin boss 5*d* extended in two parts in the opposite direction of the one ends of swing links 5*a* and 5*b* such that a driving device for operating swing links 5*a* and 5*b* is connected to swing links 5*a* and 5*b* through pin boss 5*d* and a pin 5*e*.

The driving device may include an electric driving device such as a motor or a hydraulic system operated by oil pressure.

Swing links 5*a* and 5*b* are swung by the operation of the driving device, and the motion of the swing links is transmitted to eccentric links 4*a* and 4*b* so as to perform a swing motion. The swing motion of eccentric links 4*a* and 4*b* changes the top deed center of piston 1, thereby varying a compression ratio.

Figure 2:
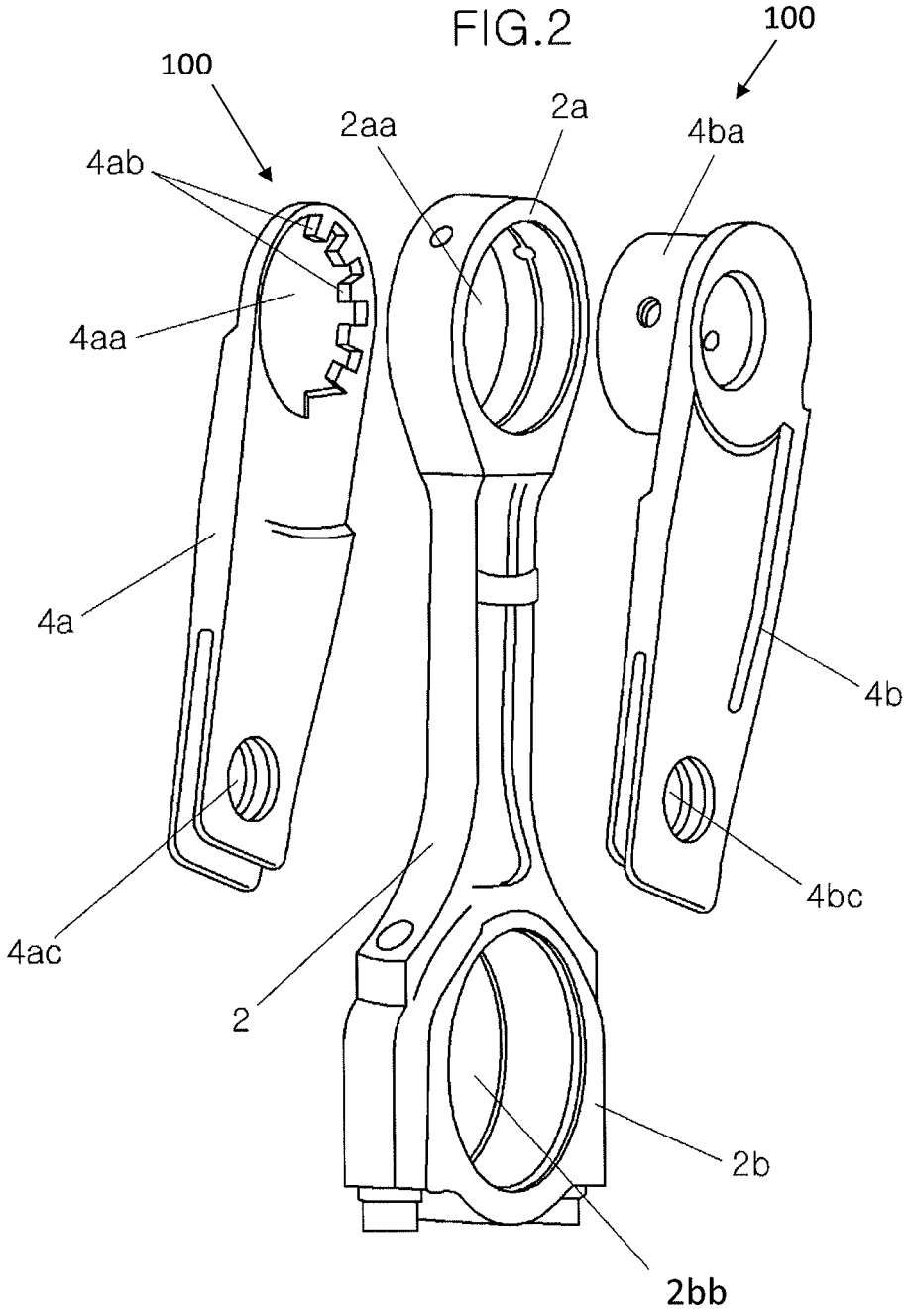
FIG. 2 is an exploded perspective view explaining a coupling method between dual eccentric links and a connecting rod according to the exemplary embodiment of the present invention.

Referring to FIG. 2, connecting rod 2 includes a small end portion 2*a* connected to piston 1 through the piston pin and a large end portion 2*b* connected to the crank shaft. The small end portion 2*a* has a relatively small diameter, and the large end portion 2*b* has a relatively large diameter. Small end portion 2*a* and large end portion 2*b* have assembling holes 2*aa* and 2*bb* formed therethrough, respectively.

Eccentric links 4*a* and 4*b* are disposed at both sides of connecting rod 2 and coupled to each other through assembling hole 2*aa*. First eccentric link 4*a* has an assembling hole 4*aa* formed through the one end thereof and coupled to the piston pin, and a plurality of assembling protrusions 4*ab* for improving assembling stability are formed on the internal circumference of the assembling hole 4*aa*, and protruded in a diametric direction while arranged at a predetermined distance from each other in a circumferential direction.

Second eccentric link 4*b* has a circular boss 4*ba* formed at the one end thereof and protruding in a direction vertical to the longitudinal direction thereof When boss 4*ba* is inserted into assembling hole 4*aa* of first eccentric link 4*a* through assembling hole 2*aa* of connecting rod 2, a plurality of assembling protrusions 4*ad* of first eccentric link 4*a* are closely attached to the outer circumference of boss 4*ba*, thereby improving the assembling workability.

Eccentric links 4*a* and 4*b* have assembling holes 4*ac* and 4*bc* formed through the other ends thereof, respectively, and coupled to the one ends of swing links 5*a* and 5*b*.

Figure 3:
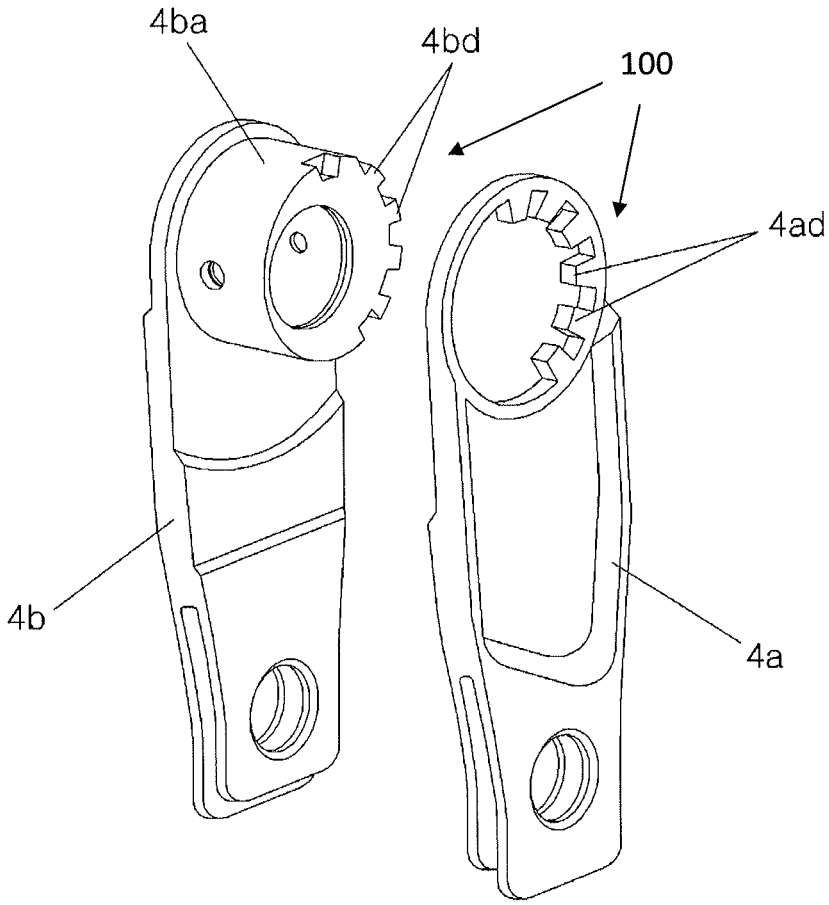
FIG. 3 is an exploded perspective view explaining a coupling method of eccentric links according to another exemplary embodiment of the present invention.

Referring to FIG. 3, in an exemplary embodiment of the present invention, the assembling protrusions 4*ad* of first eccentric link 4*a* are shaped with a plurality of gear teeth 4*ad* formed on the inner circumference of assembling hole 4*aa* of first eccentric link 4*a* and arranged at a predetermined distance from each other in a circumferential direction, and a plurality of gear teeth 4*bd* to be engaged with gear teeth 4*ad* are formed on the outer circumference of boss 4*ba* of second eccentric link 4*b* and arranged at a predetermined distance from each other in a circumferential direction. First and second eccentric links 4*a* and 4*b* are engaged with each other through gear teeth 4*ad* and 4*bd*, thereby further strengthening the connection.

Figure 4:
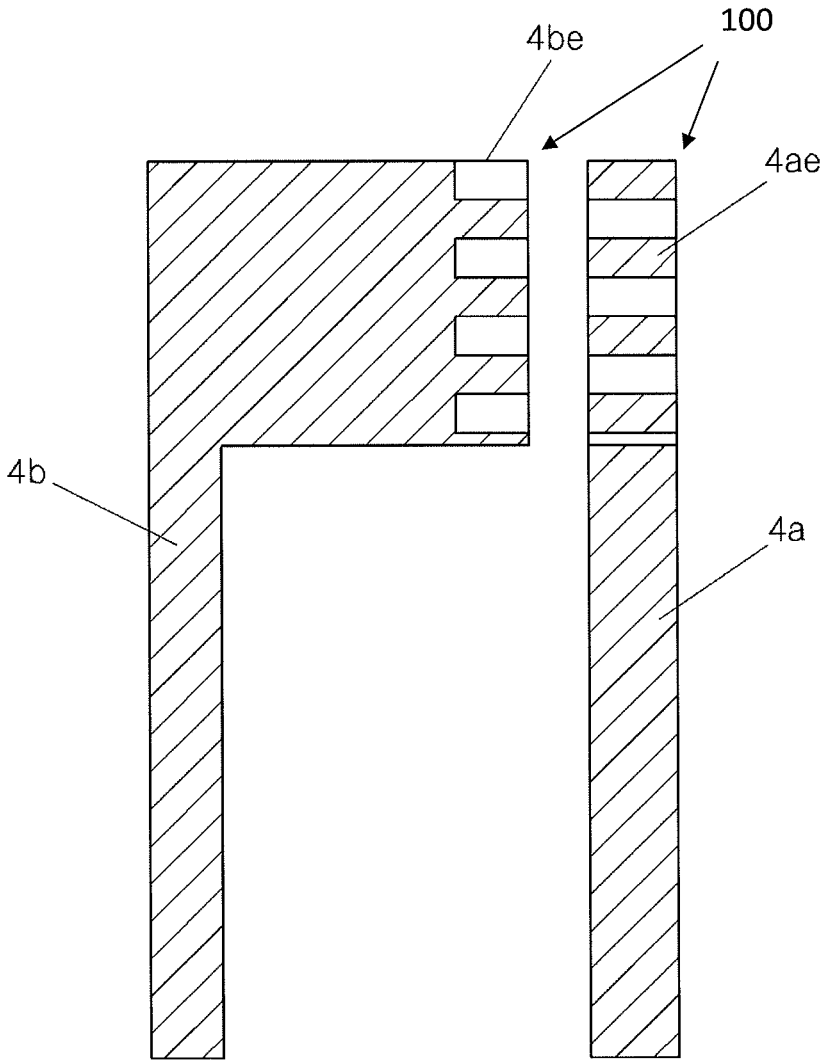
FIG. 4 is an exploded perspective view explaining a coupling method of eccentric links according to yet another exemplary embodiment of the present invention.

Referring to FIG. 4, in another exemplary embodiment of the present invention, first and second eccentric links 4*a* and 4*b* have spline gears 4*ae* and 4*be* formed at the one ends thereof. As spline gears 4*ae* and 4*be* are engaged with each other to connect first and second eccentric links 4*a* and 4*b*, the connection is further strengthened.

Referring to FIG. 5, in further another exemplary embodiment of the present invention, an arc-shaped assembling protrusion portion 4*ag* is formed on a side surface of first eccentric link 4*a* facing second eccentric link 4*b* and protruded to the outside, and an arc-shaped assembling groove 4*af* or assembling hole is formed toward the inside and disposed symmetrically with assembling protrusion portion 4*ag* in a vertical direction. An arc-shaped assembling groove 4*bg* or assembling hole is formed toward the inside at a side surface of protruding boss 4*ba* of second eccentric link 4*b* facing first eccentric link 4*a*, and an arc-shaped assembling protrusion portion 4*bf* is formed so as to protrude to the outside. Assembling protrusion portion 4*ag* of first eccentric link 4*a* is inserted and coupled into assembling groove 4*bg* or assembling hole of second eccentric link 4*b*, and assembling protrusion portion 4*bf* of second eccentric link 4*b* is inserted and coupled into assembling groove 4*af* of first eccentric link 4*a*.

The connection structure of first and second eccentric links 4*a* and 4*b* is suitable for a case in which a low load is applied to first and second eccentric links 4*a* and 4*b* or an excessive increase of stiffness is not needed.

A pair of arc-shaped assembling protrusion portions may be vertically symmetrically formed in first eccentric link 4*a*, and a pair of assembling grooves or assembling grooves into which the assembling protrusion portions are inserted and coupled may be vertically symmetrically formed in second eccentric link 4*b*. On the contrary to this structure, a pair of arc-shaped assembling grooves or assembling holes may be vertically symmetrically formed in first eccentric link 4*a*, and the pair of arc-shaped assembling protrusion portions inserted and coupled into the assembling grooves may be vertically symmetrically formed in second eccentric link 4*b*.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings.

The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable compression ratio (VCR) apparatus, comprising:

a piston;

a connecting rod having one end coupled to the piston through a piston pin to transmit a motion of the piston to a crank shaft;

a first eccentric link and a second eccentric link, each having one end eccentrically connected to the one end of the connecting rod through the piston pin;

dual swing links, each having one end connected to the other end of the first eccentric link or the other end of the second eccentric link to pivot the eccentric links with respect to the piston pin; and a connecting assembly connecting the one end of the first eccentric link and the one end of the second eccentric link to each other;

wherein the connecting rod has an assembling hole formed through the one end thereof, and wherein the connecting assembly includes:

a circular boss foamed in the one end of the first eccentric link and protruding to be inserted into the assembling hole; and a plurality of assembling protrusions formed in the one end of the second eccentric link and arranged in a circumferential direction so as to be closely attached to an outer circumference of the boss.

2. The VCR apparatus as defined in claim 1, wherein the piston has an assembling groove formed toward the inside from the bottom thereof, and the one end of the connecting rod and the one ends of the first and second eccentric links are inserted into the assembling groove and connected to the piston through the piston pin.

3. The VCR apparatus as defined in claim 2, wherein the one ends of the swing links are pivotally coupled to the other ends of the first and second eccentric links.

4. The VCR apparatus as defined in claim 3, wherein the other ends of the swing links are integrally connected to each other at a connection portion so as to form a single body, and the connection portion has a pin boss extended in two parts in the opposite direction of the one ends of the swing links such that a driving device for swinging the swing links is connected to the swing links through the pin boss and a pin.

5. A variable compression ratio (VCR) apparatus, comprising:

a piston;

a connecting rod having one end coupled to the piston through a piston pin to transmit a motion of the piston to a crank shaft;

a first eccentric link and a second eccentric link, each having one end eccentrically connected to the one end of the connecting rod through the piston pin;

dual swing links, each having one end connected to the other end of the first eccentric link or the other end of the second eccentric link to pivot the eccentric links with respect to the piston pin; and a connecting assembly connecting the one end of the first eccentric link and the one end of the second eccentric link to each other;

wherein the connecting rod has an assembling hole formed through the one end thereof, and the connection assembly includes a circular boss formed in the one end of the first eccentric link and protruding to be inserted into the assembling hole, a pair of arc-shaped assembling protrusion portions protruding on a side surface of the boss facing the second eccentric link and formed symmetrically in a vertical direction, and a pair of arc-shaped assembling grooves or assembling holes formed at a side surface of the second eccentric link facing the boss and disposed symmetrically in a vertical direction so as to be coupled to the pair of assembling protrusions.

6. A variable compression ratio (VCR) apparatus, comprising:

a piston;

a connecting rod having one end coupled to the piston through a piston pin to transmit a motion of the piston to a crank shaft;

a first eccentric link and a second eccentric link, each having one end eccentrically connected to the one end of the connecting rod through the piston pin;

dual swing links, each having one end connected to the other end of the first eccentric link or the other end of the second eccentric link to pivot the eccentric links with respect to the piston pin; and a connecting assembly connecting the one end of the first eccentric link and the one end of the second eccentric link to each other;

wherein the connecting rod has an assembling hole formed through the one end thereof, and the connection assembly includes a circular boss formed in the one end of the first eccentric link and protruding to be inserted into the assembling hole, an arc-shaped assembling protrusion portion and an arc-shaped assembling groove or assembling hole formed at a side surface of the boss facing the second eccentric link and disposed symmetrically in a vertical direction, an assembling groove or assembling hole formed at a side surface of the second eccentric link facing the boss and inserted and coupled into the assembling protrusion portion of the first eccentric link, and an assembling protrusion portion formed symmetrically with the assembling groove or assembling hole and protruding to be inserted into the assembling groove or assembling hole of the first eccentric link.

* * * * *